US007758061B2

(12) United States Patent
Staudinger

(10) Patent No.: US 7,758,061 B2
(45) Date of Patent: Jul. 20, 2010

(54) SKI STRUCTURE

(75) Inventor: Peter Staudinger, Breitenschützing (AT)

(73) Assignee: Fischer Gesellschaft mbH, Ried im Innkreis (AT)

( * ) Notice: Subject to any disclaimer, the term of this patent is extended or adjusted under 35 U.S.C. 154(b) by 322 days.

(21) Appl. No.: 11/728,054

(22) Filed: Mar. 23, 2007

(65) Prior Publication Data

US 2007/0222187 A1 Sep. 27, 2007

(30) Foreign Application Priority Data

Mar. 23, 2006 (AT) ..... A 498/2006

(51) Int. Cl.
*A63C 5/04* (2006.01)

(52) U.S. Cl. ..... 280/609; 280/608

(58) Field of Classification Search ..... 280/604, 280/603, 602, 607, 608, 609, 610; 441/74, 441/68

See application file for complete search history.

(56) References Cited

U.S. PATENT DOCUMENTS 2,581,532 A * 1/1952 Hem ..... 280/610
3,369,821 A * 2/1968 Weber ..... 280/610
3,408,086 A * 10/1968 Bennett ..... 280/604
3,652,102 A * 3/1972 Eaton ..... 280/610
3,871,671 A * 3/1975 Bildner ..... 280/608
4,118,050 A * 10/1978 Schnurrenberger ..... 280/604
4,178,012 A * 12/1979 Roth et al. ..... 280/604
4,223,909 A * 9/1980 Danner et al. ..... 280/604
4,440,418 A * 4/1984 Staufer ..... 280/604
4,919,447 A * 4/1990 Jackson et al. ..... 280/604
5,167,552 A * 12/1992 Johnson, III ..... 441/74
5,328,200 A * 7/1994 Pelizzari ..... 280/609
5,344,177 A * 9/1994 Rouser et al. ..... 280/610
5,725,237 A * 3/1998 Krafft et al. ..... 280/609
5,727,807 A * 3/1998 Krafft et al. ..... 280/609
5,788,259 A * 8/1998 Emig ..... 280/609
6,357,781 B1 * 3/2002 Jeandin ..... 280/609
6,386,561 B1 * 5/2002 Hanson ..... 280/87.042
7,216,887 B2 * 5/2007 Riepler ..... 280/608

FOREIGN PATENT DOCUMENTS

DE 36 28 292 A1 2/1987

* cited by examiner

*Primary Examiner*—Hau V Phan
(74) *Attorney, Agent, or Firm*—Laurence A. Greenberg; Werner H. Stemer; Ralph E. Locher

(57) ABSTRACT

A ski has rim-side edges that are formed of synthetic material. This allows for easy production of incisions and an ideal course of movement is assured even under unfavorable snow conditions. For this purpose, the incisions extend over at least a portion of the width of at least one synthetic material edge.

4 Claims, 2 Drawing Sheets

FIG. 1
PRIOR ART
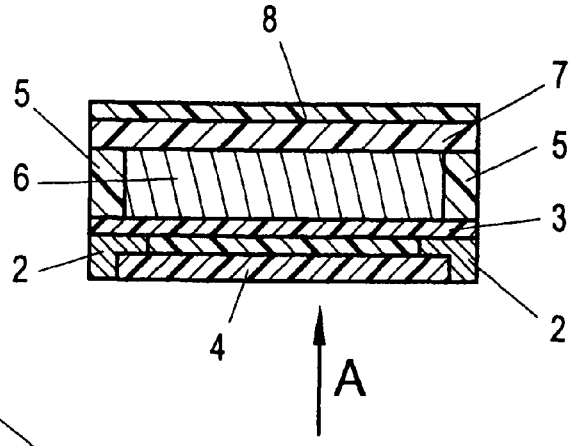
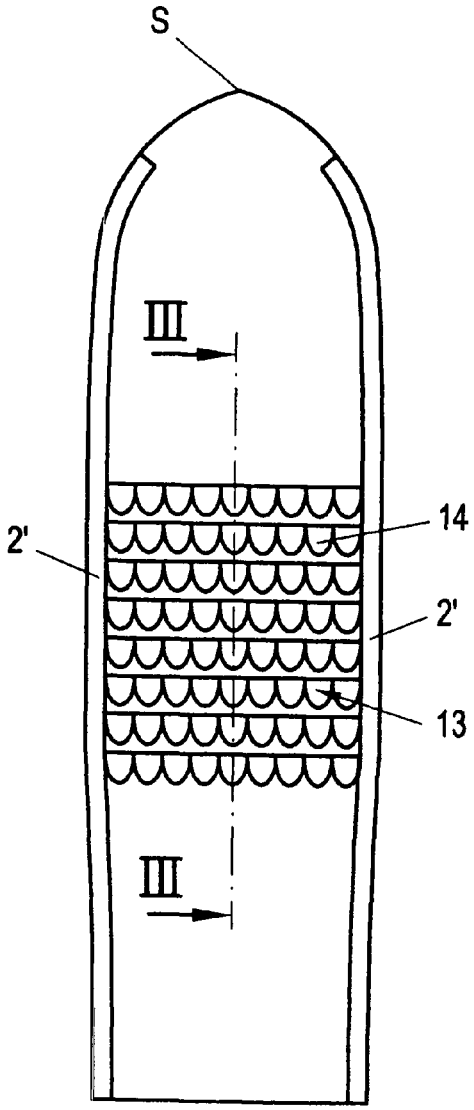
FIG. 2
PRIOR ART

FIG. 3
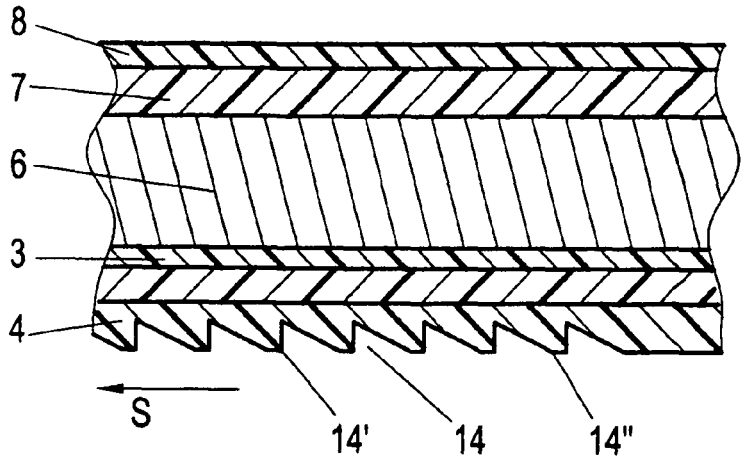
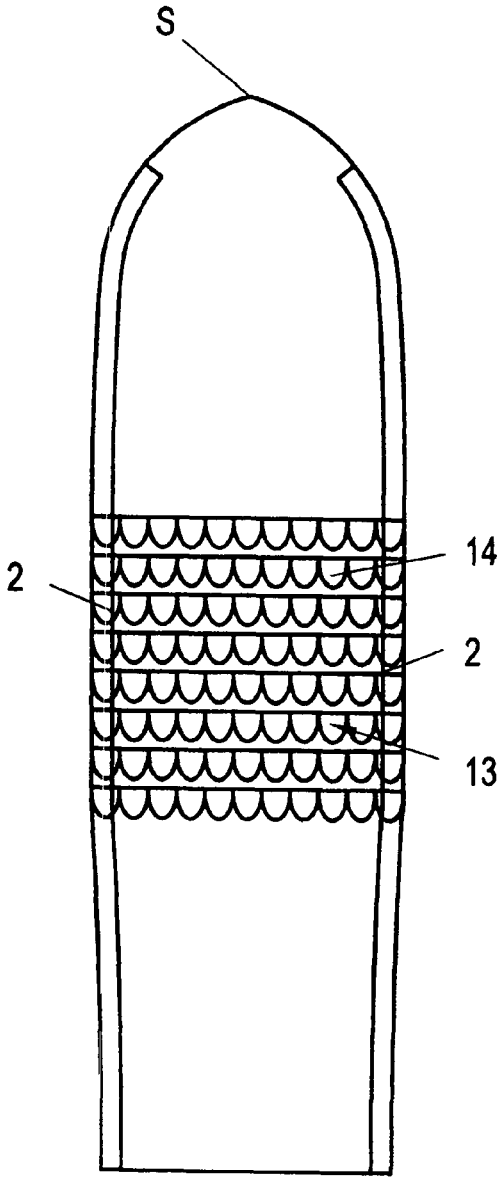
FIG. 4

SKI STRUCTURE

CROSS-REFERENCE TO RELATED APPLICATION

This application claims the priority, under 35 U.S.C. §119, of Austrian application A 493/2006, filed Mar. 23, 2006; the prior application is herewith incorporated by reference in its entirety.

BACKGROUND OF THE INVENTION

Field of the Invention

The invention relates to a ski having rim-side longitudinal edges made of synthetic material and incisions which extend over at least a portion of the running surface between the two synthetic material edges.

The ski construction according to the invention is particularly intended for cross-country skis and for touring skis and may possibly also be used for a classical Alpine ski. A classical Alpine ski—also referred to as a regular downhill ski—is a type of ski where the skier ascends on a lift, by way of example, and skis downhill from there.

The touring ski differs from the cross-country ski in that one's heel is kept free for walking just as in the cross-country ski, which means that the boot can be lifted off the ski at the heel side, yet that the binding system is fixed for the purpose of going downhill. That is, the heel will be fixed to the ski when going downhill. For touring skis, the present invention basically is usable on a terrain that is not too steep.

It is prior art to produce ski edges from steel. The disadvantage of these edges consists in that their production or processing, in particular in case of profiled edges, e.g. sawtooth-like edges, requires a lot of work.

German published patent application DE 36 28 292 A1 describes a cross-country ski having a running surface made of synthetic material. A running edge of synthetic material is provided possibly on at least one edge of the running surface. That disclosure, however, is not directed at improving the kick-off behavior, but at providing a certain type of protection against wear in the upper edges of the ski. In this way, as indicated in the specification of that publication as an object thereof, the edges of the running surface shall not become damaged during crossing of the skis when using the "skating step." The publication does not disclose working cuts into the edge of the running surface over at least a portion of the width of at least one synthetic material edge in the form of a sawtooth-like pattern.

SUMMARY OF THE INVENTION

It is accordingly an object of the invention to provide a novel ski structure, which overcomes the disadvantages of the heretofore-known devices and methods of this general type and which provides for a solution that ensures an ideal course of movement when cross-country skiing in a laid track or during Alpine skiing, also if the snow conditions are unfavorable, for example in the case of hard or crusted snow. An object is to provide a suitable kick-off option by choosing a special material for the edges.

With the foregoing and other objects in view there is provided, in accordance with the invention, a ski, comprising:

rim-side longitudinal edges formed of synthetic material;

a running surface extending between said synthetic material edges, said running surface having incisions formed therein extending over at least a portion of said running surface between said synthetic material edges and said incisions extending over at least a portion of a width of at least one of said synthetic material edges.

In accordance with an added feature of the invention, the synthetic material edges are formed, in longitudinal section, with a sawtooth-like profile having a relatively sharp forward edge and a relatively flat ending. Preferably, the flat edge is forward and the sharp edge points back, as seen in a running direction of the ski. This profile provides for a particularly favorable kick-off behavior.

Other features which are considered as characteristic for the invention are set forth in the appended claims.

Although the invention is illustrated and described herein as embodied in ski structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1 is a cross-section taken through a prior art ski structure;

FIG. 2 is a bottom plan view thereof, viewed in the direction of arrow A in FIG. 1;

FIG. 3 is a section taken along the line III-III in FIG. 2; and

FIG. 4 is a bottom plan view showing the ski with a running surface according to the invention.

DESCRIPTION OF THE PREFERRED EMBODIMENTS

Referring now to the figures of the drawing in detail and first, particularly, to FIG. 1 thereof, the ski has a running surface 4 formed as a stiffening layer and edges 2 which have an L-shaped cross-section in this instance. A layer preferably stiffening the ski body is denoted by 3, and two side edges of synthetic material are denoted by 5. A ski core is denoted by 6, an upper reinforcing layer is denoted by 7, and an uppermost cover layer is denoted by 8. Typically, the cover layer serves for applying a décor.

Such ski constructions are used in Alpine skiing, if they have edges made of steel. In cross-country skiing or in the Nordic range, usually no steel edges are used for carrying out the classic step, i.e. the diagonal step, yet also for carrying out the skating step normally ski constructions are used which do not have steel edges, since what is important there is not going downhill on a slope, but skiing in a laid track. There exists an intermediary form between Alpine skiing and cross-country skiing which, as regards the sequence of movement, corresponds to cross-country skiing, in which, however, the skier does not move on a laid cross-country skiing course, but on free terrain. And for this purpose, and also when going downhill for longer distances, cross-country skis are built which use lateral steel edges so that, when going downhill, e.g. when the snow is hard and crusted, a sufficient foothold can be achieved.

The problem is that for doing cross-country skiing, the user has to be able to kick off. On plane terrain, sliding shall be easy when going downhill. On slightly ascending terrain, a kick-off must be possible. Usually, in this field of use this is enabled by mechanical stepping aids, such as also illustrated by way of example in Austrian patent AT 397 915 B. When used on skis in the field of cross-country skiing with steel edges, however, there is the problem that when using cutting blades, it is not possible to cut beyond the steel edges, i.e. the stepping aid is only located between the steel edges, as visible in FIG. 2.

In FIG. 2, the visible legs of the steel edge are denoted by 2'. From the region 13, the so-called stepping region, i.e. that region where the mechanical stepping aid—here shown in a simplified illustration—is formed by the serial arrangement of incisions 14 which, in their front end facing the ski tip S, have a straight-line end and, towards the rear side, are rounded in this exemplary embodiment, it can be seen that this serial arrangement of scales is provided only in between the steel edges.

In FIG. 3, the incision 14 is schematically illustrated, and it is shown as a sawtooth-like pattern in longitudinal section, i.e. the direction of movement of the ski is in the direction of the ski tip S, indicated by the arrow in the direction S. There is a front, sharp edge 14' and a flat ending 14". This measure provides for the foothold in the snow surface during a kick-off, and for the comparatively good sliding ability during sliding due to the flat ending 14". The disadvantage of these constructions is that the steel edge cannot be processed by these processing means so that there will be no stepping effect on the outer zone, primarily when crossing inclined slopes and the like, but slipping will occur on said smooth edge.

To solve this problem according to the invention, a ski construction according to FIG. 4 is proposed which uses edges of synthetic material instead of edges of steel. In this exemplary embodiment, the stepping aid is represented by incisions 14 which extend over the entire width of the ski, i.e. also over the legs 2 of the respective synthetic material edge, and which have the advantage of being produced on the running surface by the same processing means as the mechanical stepping aids, or mechanical incisions 14, respectively. Within the scope of the invention, such incisions may be produced over merely a portion of the width of the longitudinal edges. As the synthetic material, ABS, polyurethane or the like may be used.

I claim:

1. A ski, comprising:

rim-side longitudinal edges formed of synthetic material;

a running surface extending between said synthetic material edges;

said running surface having incisions formed therein extending over at least a portion of said running surface between said synthetic material edges; and at least one of said rim-side longitudinal edges having incisions formed therein extending over at least a portion of a width thereof.

2. The ski according to claim 1, wherein said incisions in said running surface and said incisions in said at least one rim-side longitudinal edge are incisions formed across a boundary between said running surface and said at least one rim-side longitudinal edge.

3. The ski according to claim 1, wherein said synthetic material edges are formed, in longitudinal section, with a sawtooth profile having a relatively sharp forward edge and a relatively flat ending.

4. The ski according to claim 3, wherein said relatively flat ending is disposed to point forward in a running direction of the ski.

* * * * *